United States Patent [19]

Sivilotti

[11] Patent Number: 4,960,501

[45] Date of Patent: Oct. 2, 1990

[54] ELECTROLYTIC CELL FOR THE PRODUCTION OF A METAL

[75] Inventor: Olivo G. Sivilotti, Kingston, Canada

[73] Assignee: Alcan International Limited, Canada

[21] Appl. No.: 296,066

[22] Filed: Mar. 12, 1989

[30] Foreign Application Priority Data

Jan. 13, 1988 [GB] United Kingdom ..... 8800674

[51] Int. Cl.[5] ..... C25C 7/00

[52] U.S. Cl. ..... 204/244; 204/245

[58] Field of Search ..... 204/243 R, 247, 70, 204/268

[56] References Cited

U.S. PATENT DOCUMENTS

| | | | |
|---|---|---|---|
| 4,055,474 | 10/1977 | Sivilotti | 204/70 |
| 4,110,178 | 8/1978 | LaCamera et al. | 204/244 X |
| 4,518,475 | 5/1985 | Sivilotti | 204/247 X |
| 4,604,177 | 8/1986 | Sivilotti | 204/247 X |

FOREIGN PATENT DOCUMENTS

| | | |
|---|---|---|
| 0101243 | 2/1984 | European Pat. Off. . |
| 727843 | 4/1955 | United Kingdom . |

OTHER PUBLICATIONS

European Search Report dated Apr. 12, 1989.

*Primary Examiner*—Donald R. Valentine

*Attorney, Agent, or Firm*—Stevens, Davis, Miller & Mosher

[57] ABSTRACT

An electrolytic cell for producing a metal, e.g. magnesium, by electrolysis has a housing in which are disposed one or more electrode assemblies each comprising a cathode assembly providing a vertical cavity in which are disposed an anode and one or more bipolar electrode assemblies disposed between the anode and cathode assembly, and baffles for preventing or impeding flow of electrolyte between adjacent cathode assemblies and/or between each cathode assembly and an adjacent wall of the housing.

10 Claims, 3 Drawing Sheets

ELECTROLYTIC CELL FOR THE PRODUCTION OF A METAL

Figure 1:
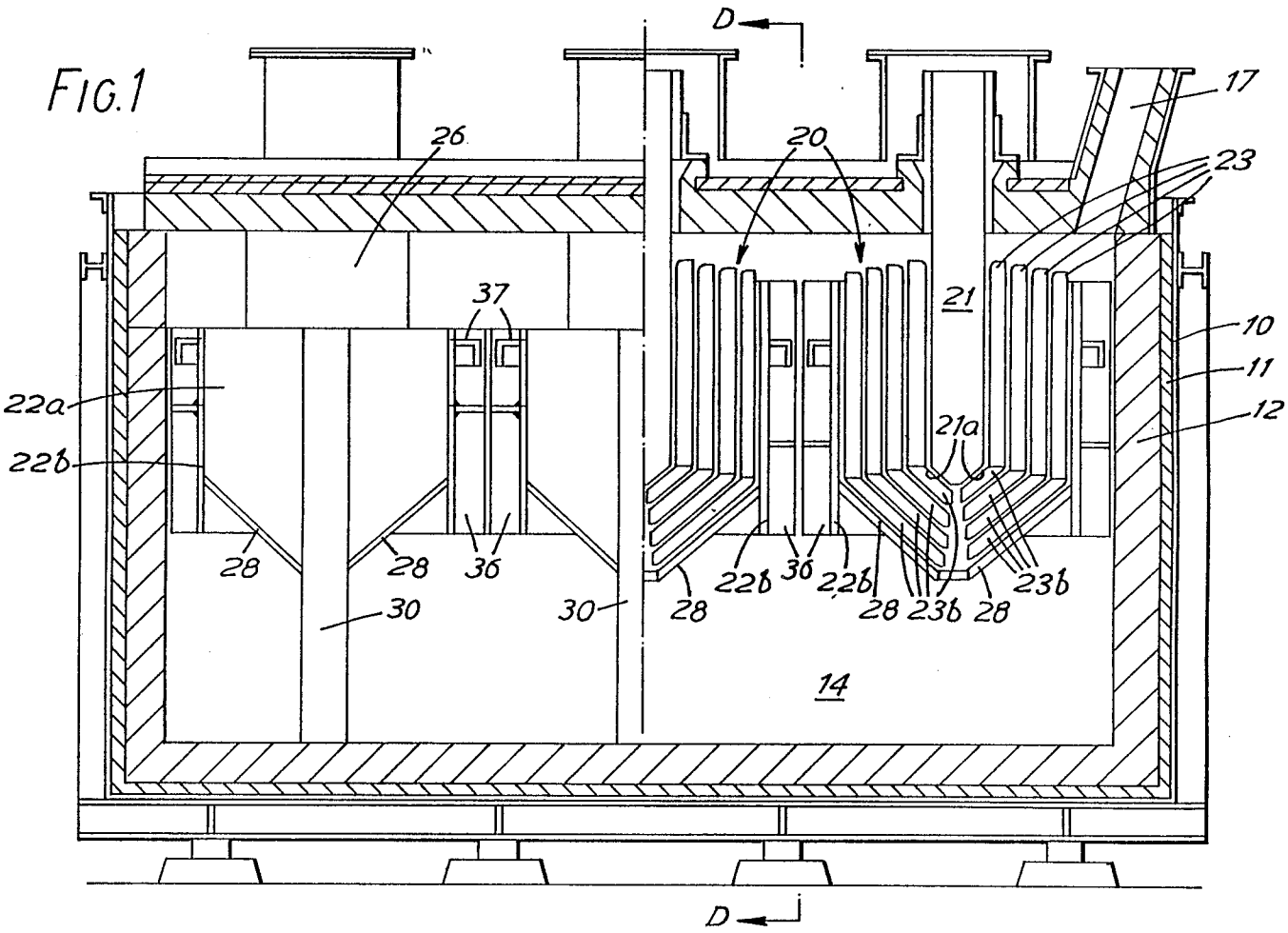

This invention relates to electrolytic cells for the production of a metal by electrolysis of a molten electrolyte which is more dense than the metal, and has a particularly useful but not exclusive application in the production of magnesium by electrolysis of molten electrolyte containing magnesium chloride.

An electrolytic cell as described in assignee's European Patent Application No. 83304465.4 has proved to have current efficiencies above 80% during its peak performance period following the energization of the cell. However, there is a gradual loss of efficiency owing to wear of the refractory walls of the electrolysis chamber giving rise to progressively increasing bypass currents which affect adversely the efficiency with which the droplets of the metal in the electrolyte can be transferred to a collection point. Wearing of the refractory wall of the electrolysis chamber permits an increasing amount of the electrolyte carrying droplets of the metal to fall back into the spaces between the electrodes where the presence of chlorine and the violent turbulence favor the back reaction.

Also, the cell voltage increases during the life of the cell owing to the consumption of graphite from the electrode assemblies due to oxidation and wear. Although the rate of change of thickness of the graphite electrodes is small compared with the thickness when initially installed, the resultant change in the anode-cathode distance is more important because of the small anode-cathode distances used in the cell. In consequence it is not uncommon for the cell to have a doubled electrical resistance by the end of its life.

The increased resistance results in a proportional increase in the heat balance. The latter is also affected by the simultaneous loss of current efficiency, because the back reaction is highly exothermic. The cell thus requires more cooling, and the cooling capacity of the heat exchanger tends to become a limiting factor on the capacity of the cell to function satisfactorily.

The present invention is concerned with increasing the effective life of these cells.

According to the present invention in one aspect there is provided an electrolytic cell for the production of a metal by electrolysis of a molten electrolyte which is more dense than the metal, comprising an electrolysis chamber, a metal collection chamber, means for conducting product metal and electrolyte from an upper region of the electrolysis chamber to the metal collection chamber, means for conducting electrolyte from the metal collection chamber to a lower region of the electrolysis chamber, at least one electrode assembly including a cathode assembly defining within it a vertical cavity, an anode disposed within said cavity, and one or more intermediate bipolar electrode assemblies disposed between the anode and the cathode assembly, and means for preventing or impeding flow of the electrolyte between the cathode assembly and a wall of the electrolysis chamber and/or between the cathode assembly and an adjacent cathode assembly.

According to a preferred feature of the invention the flow-preventing or flow-impeding means comprises baffle means.

The baffle means may comprise one or more horizontal baffles having one lengthwise edge thereof secured to an outer face of the cathode assembly and having an opposite lengthwise edge thereof embedded in said wall of the electrolysis chamber.

Alternatively, the baffle means may include a plate arranged to conduct electric current to the cathode assembly, which plate extends through and in sealing relationship with said wall of the electrolysis chamber and operates to prevent or impede flow of the electrolyte in the space between the cathode assembly and said wall.

In another arrangement according to the invention, said cathode assembly has an end remote from the collection chamber disposed in close substantially sealing proximity to said wall of the electrolysis chamber, said flow-preventing or flow-impeding means comprising one or more horizontal layers in the surface of said wall facing the cathode assembly which layers are of a material more highly resistant than other parts of said surface to erosion by the passage of electrolyte thereover.

According to another aspect of the invention there is provided an electrolytic cell for the production of a metal by electrolysis of a molten electrolyte which is more dense than the metal, comprising an electrolysis chamber, a metal collection chamber, means for conducting product metal and electrolyte from an upper region of the electrolysis chamber to the metal collection chamber, means for conducting electrolyte from the metal collection chamber to a lower region of the electrolysis chamber, and at least one electrode assembly including a cathode assembly defining within it a vertical cavity, an anode disposed within the cavity and a plurality of intermediate bipolar electrode assemblies, at least one of which bipolar electrode assemblies is thicker than the next adjacent bipolar electrode assembly nearer the anode.

In preferred arrangements, said bipolar electrode assemblies have decreasing thicknesses considered in order from the cathode assembly to the anode.

Figure 2:
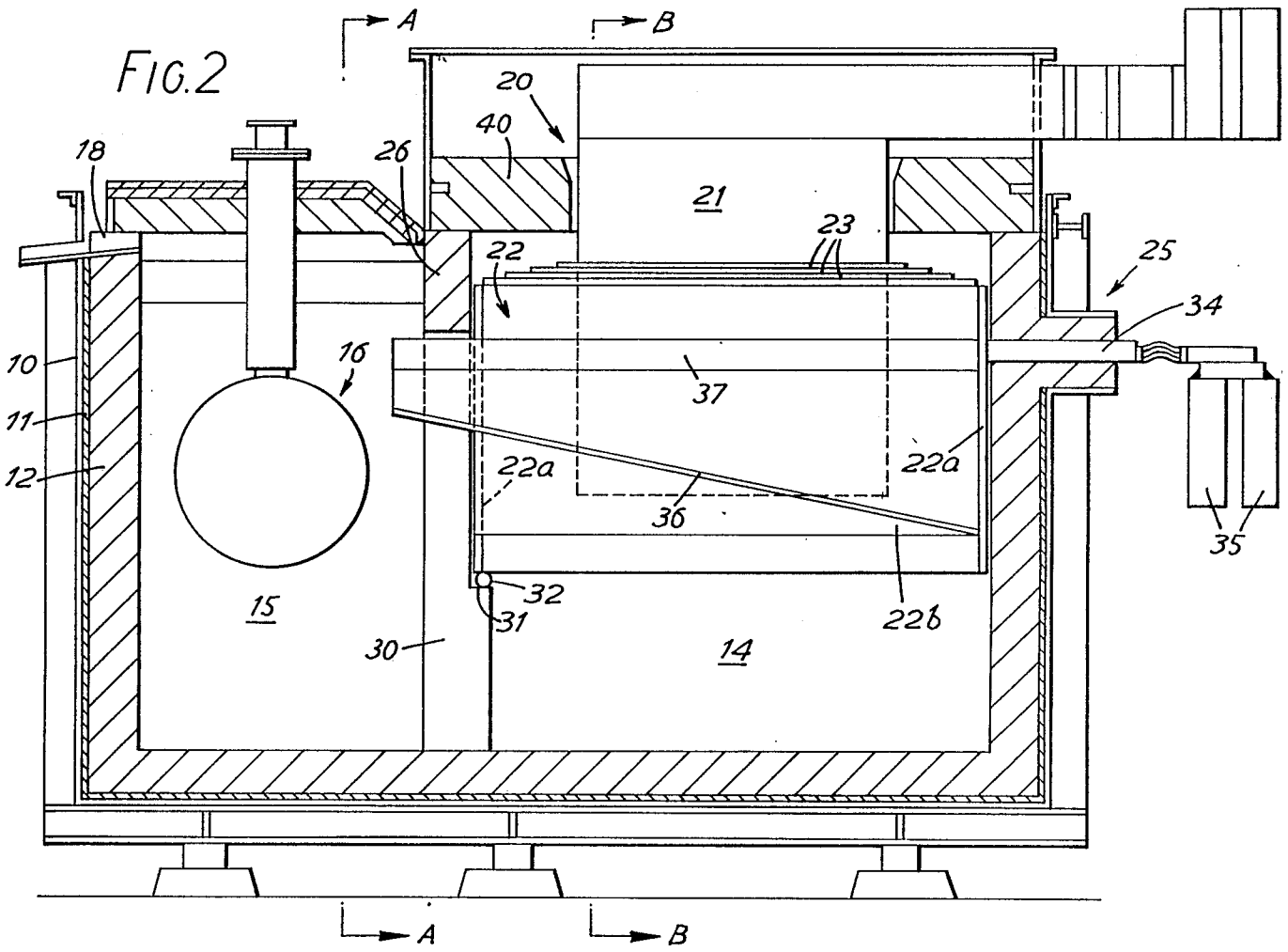
Figure 3:
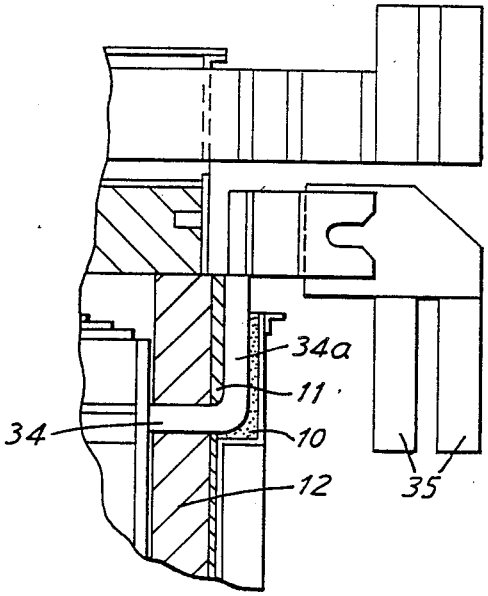

Some embodiments of the invention will now be described by way of example with reference to the accompanying drawings in which:

FIG. 1 is a compound sectional elevation of an electrolytic cell according to the invention, the left and right hand parts of the drawing being sectional views on the planes A—A and B—B respectively of FIG. 2, FIG. 2 is a sectional end elevation on the plane D—D of FIG. 1, and FIG. 3 is a partial view corresponding to FIG. 2 and illustrating a modification.

The basic construction of the electrolytic cell will now be described with reference to FIGS. 1 to 2 of the drawings. The cell is designed for the production of magnesium by electrolysis of a molten electrolyte containing magnesium chloride. In the electrolysis, magnesium is formed at the cathode and chlorine at the anode. Since both are lighter than the electrolyte, both migrate to the surface and are separately removed from the cell.

The electrolytic cell comprises a steel outer shell 10, and inner layer 11 of thermal insulating material, and a massive refractory lining 12 of material which, in the present instance, is resistant to both molten magnesium and the molten electrolyte. The cell provides an electrolysis chamber 14, and a magnesium collection chamber 15, chlorine and magnesium metal being respectively withdrawn from the two chambers through a duct 17 and a metal tapping hole 18 which extends through the wall of chamber 15. A level control device 16 is disposed in the metal collection chamber 15. In the illustrated constructions, the electrolysis chamber 14 houses three electrode assemblies 20, each including an anode 21, a cathode assembly 22 and four intermediate bipolar electrode assemblies 23.

Each cathode assembly 22 comprises two relatively narrow vertical end plates 22*a* disposed respectively adjacent the refractory brickwork of the rear wall 25 of chamber 14 and adjacent a curtain wall 26 between chambers 14 and 15, and two vertical side plates 22*b* joining the end plates so as jointly to define a vertical cavity within the assembly. The four bipolar electrode assemblies 23 are nested within each other in the cavity in the cathode assembly 22, and each assembly 23 similarly comprises two narrow end plates interconnected by two side plates 23*a*, the upper portions of which are vertical but the bottom portions 23*b* of which are inclined towards each at an angle of 45°.

Each of the cathode assemblies 22 is secured to the rear wall 25 of the electrolysis chamber 14, and in turn supports the four bipolar electrode assemblies 23, the assemblies 22, 23 being spaced from each other and from the anode 21 by electrically insulating spacers (not shown). For its support purposes, the two parallel side plates 22*b* of the cathode assembly have inwardly inclined floor elements 28 which are suitably braced from the side walls 22*a* and 22*b* by continuous welds and which extend towards each other but leave between them a gap for the upward passage of the molten electrolyte. These floor elements of the cathode assembly support through suitable spacers the weight of the nested bipolar electrode assemblies 23. The bottom tips of the inclined bottom end portions 23*b* of each bipolar electrode are in abutment with each other at only a few locations spaced along the central plane of the electrode assembly so as to form between them elongate gaps extending along the said plane allowing controlled entry of the electrolyte into the spaces between the electrode assemblies. The bottom portion of the anode 21 is wedge-shaped to provide bottom faces 21*a* extending parallel to the inclined wall portions 23*b* the bipolar electrode assemblies.

Curtain wall 26 extends between the upper ends of the electrolyisis and collection chambers and extends a short distance below the surface of the electrolyte, the wall being supported on support pillars 30 resting on the bottom of the cell. An angle member 37 is welded to the outer face of each side plate 22*b* of the cathode assembly and forms an inverted channel which collects the molten droplets of magnesium metal and conveys them under the bottom edge of the curtain wall into the collection chamber where the metal forms a surface layer and is tapped off periodically through the metal tap hole 18 in the wall of the collection chamber. Ledges 31 on the pillars 30 support, through rollers 32, the adjacent ends of the cathode assemblies so as to allow the assemblies to expand and contract horizontally towards and away from the rear wall 25 of the electrolysis chamber.

The anodes 21 are supported from the cover 40 of the electrolysis chamber 14.

The end of each cathode assembly adjacent the rear wall 25 has secured to it near its upper end a robust plate conductor 34 which is of substantially the same width as the end plate 22*a* of the assembly and which extends in a suitably sealed and heat-insulated manner through the wall of the cell for connection to the busbars 35. The plate conductors 34 are built into the wall 25 so that when the cell reaches the end of its life, the cathode assemblies can be lifted out of the electrolysis chamber after the top courses of refractory brickwork 12 have been removed. Similarly, the new assemblies can be placed in positions similar to those from which the former assemblies have been removed and the top courses of the refractory brickwork can then be reconstructed. The plate conductors 34 serve also as baffles to prevent electrolyte with any entrained droplets of metal from passing downward between the cathode assembly and the rear wall 25 of the electrolysis chamber, and thus assists in ensuring that droplets of metal pass under the curtain wall 26 into the collection chamber. Further baffles 36 are provided, for the same purpose, between adjacent cathode assemblies 22. Baffles 36 comprise flanges welded to the outer faces of the cathode side plates 22*a* and sloping upwardly from the rear wall of the cell under the curtain wall 26 and project into the collection chamber. These baffles co-operate with the corresponding baffles on the adjoining cathode assemblies to prevent electrolyte from flowing downward between the two cathode assemblies. A working clearance is however necessarily left between these baffles. The part of side plate 22*b* between its angle member 37 and baffle 36 extends under curtain wall 26 into the collection chamber and is coextensive with angle member 37 and baffle 36.

The plates which are assembled to form successive bipolar electrodes are conveniently of graduated thickness, the plates of the bipolar electrodes nearest the cathode assembly having the greatest thickness and the plates of the bipolar electrodes nearest the anode having the smallest thickness. The difference in the thickness between the plates of successive bipolar electrodes is equal to the wear on the plates during a cell run. When the cell is closed down, the electrode assemblies are removed, the innermost assembly is discarded and the plates of each of the other assemblies are trimmed to the smaller dimensions of the next smaller electrode, so that only the largest electrode has to be renewed.

FIG. 3 illustrates a modification of the arrangement of FIGS. 1 and 2 in which the plate conductor 34 connected to each cathode assembly instead of projecting outwardly through the full thickness of the rear wall 25 of the cell, has its outer end portion 34*a* directed upwardly between the outer shell 10 and the layer of insulation 11 so as to project upward from the top edge of the wall of the cell. The top ends of the plate conductors are then electrically connected to the busbars through connecting elements which are appropriately shaped according to the position of the busbars.

In an alternative arrangement according to the invention (not illustrated) each cathode assembly 22 has secured to its end plate 22*a* adjoining the rear wall 25 a baffle plate which extends in a sealing manner through, and is supported by, the refractory lining wall 12 of the cell, and the two vertical side plates 22*b* of the cathode assembly have welded to their outer faces plates which rest on and are welded to respective electrical connectors extending through the wall 25 of the cell for connection to the busbars 35. To install the cathode and bipolar electrode assemblies, the top portion of the refractory wall is left unfinished to enable the assemblies to be lowered until the bottom edges of the plates rest on the projecting portions of the connectors. The plates are then welded to the connectors in situ, and the wall 26 is built up above the baffle plate and connectors. As in the illustrated construction flanges are welded to adjoining cathode structures to form baffles to prevent or reduce downward flow of electrolyte between the cathode structures.

The refractory wall 12, where it extends about the electrolysis chamber 14, may additionally or alternatively incorporate one or more horizontal layers of a refractory material having a higher resistance than the main material of the wall 12 to erosion by the molten electrolyte. These layers are disposed Just below the top edges of the end plates 22*a* of the cathode assemblies. The end plates 22*a* are placed in close proximity to the wall 12. Since the layers have a high resistance to erosion by the electrolyte, they serve to maintain a good seal with the cathode assemblies through the life of the cell, while allowing materials having a lower erosion resistance, which are usually cheaper, to be employed for the major part of the wall 12 about the electrolysis chamber 14.

I claim:

1. An electrolytic cell for the production of a metal by electrolysis of a molten electrolyte which is more dense than the metal, comprising an electrolysis chamber, a metal collection chamber, means for conducting product metal and electrolyte from an upper region of the electrolysis chamber to the metal collection chamber, means for conducting electrolyte from the metal connection chamber to a lower region of the electrolysis chamber, at least one electrode assembly including a cathode assembly defining within it a vertical cavity, an anode disposed within said cavity, at least one intermediate bipolar electrode assembly disposed between the anode and the cathode assembly, and baffle means for preventing or impeding flow of the electrolyte between the cathode assembly and a wall of the electrolysis chamber and/or between the cathode assembly and an adjacent cathode assembly said baffle means comprising at least one horizontal baffle having one lengthwise edge thereof secured to an outer face of the cathode assembly and having an opposite lengthwise edge thereof embedded in said wall of the electrolysis chamber.

2. An electrolytic cell as claimed in claim 1, wherein the cathode assembly is supported at its end adjoining the collection chamber by means permitting endwise expansion and contraction of the cathode assembly in a horizontal direction.

3. An electrolytic cell for the production of a metal by electrolysis of a molten electrolyte which is more dense than the metal, comprising an electrolysis chamber, a metal collection chamber, means for conducting product metal and electrolyte from an upper region of the electrolysis chamber to the metal collection chamber, means for conducting electrolyte from the metal collection chamber to a lower region of the electrolysis chamber, and at least one electrode assembly including a cathode assembly defining within it a vertical cavity, an anode disposed within the cavity and a plurality of intermediate bipolar electrode assemblies, at least one of which bipolar electrode assemblies being thicker than the next adjacent bipolar electrode assembly nearer the anode.

4. An electrolytic cell as claimed in claim 3, wherein said bipolar electrode assemblies have decreasing thicknesses considered in order from the cathode assembly to the anode.

5. An electrolytic cell for the production of a metal by electrolysis of a molten electrolyte which is more dense than the metal, comprising an electrolysis chamber, a metal collection chamber, means for conducting product metal and electrolyte from an upper region of the electrolysis chamber to the metal collection chamber, means for conducting electrolyte from the metal collection chamber to a lower region of the electrolysis chamber, at least one electrode assembly including a cathode assembly defining within it ia vertical cavity, an anode disposed within said cavity, at least one intermediate bipolar electrode assembly disposed between the anode and the cathode assembly, and baffle means for preventing or impeding flow of the electrolyte between the cathode assembly and a wall of the electrolysis chamber and/or between the cathode assembly and an adjacent cathode assembly said baffle means including a plate arranged to conduct electric current to the cathode assembly, which plate extends through and in sealing relationship with said wall of the electrolysis chamber and operates to prevent or impede flow of the electrolyte in the space between the cathode assembly and said wall.

6. An electrolytic cell for the production of a metal by electrolysis of a molten electrolyte which is more dense than the metal, comprising an electrolysis chamber, a metal collection chamber, means for conducting product metal and electrolyte from an upper region of the electrolysis chamber to the metal collection chamber, means for conducting electrolyte from the metal collection chamber to a lower region of the electrolysis chamber, at least one electrode assembly including a cathode assembly defining within it a vertical cavity, an anode disposed within said cavity, at least one intermediate bipolar electrode assembly disposed between the anode and the cathode assembly, and baffle means for preventing or impeding flow of the electrolyte between the cathode assembly and a wall of the electrolysis chamber and/or between the cathode assembly and an adjacent cathode assembly, said baffle means including a plate arranged to conduct electric current to the cathode assembly, which plate extends through and in sealing relationship with a refractory and insulating lining of the cell but extends upward between said lining and a metal shell surrounding the lining.

7. An electrolytic cell for the production of a metal by electrolysis of a molten electrolyte which is more dense than the metal, comprising an electrolysis chamber, a metal collection chamber, means for conducting product metal and electrolyte from an upper region of the electrolysis chamber to the metal collection chamber, means for conducting electrolyte from the metal collection chamber to a lower region of the electrolysis chamber, at least one electrode assembly including a cathode assembly defining within it a vertical cavity, an anode disposed within said cavity, at least one intermediate bipolar electrode assembly disposed between the anode and the cathode assembly, and baffle means for preventing or impeding flow of the electrolyte between the cathode assembly and a wall of the electrolysis chamber and/or between the cathode assembly and an adjacent cathode assembly, said baffle means including between each cathode assembly and a next adjacent cathode assembly at least one baffle plate extending across the electrolysis chamber and towards the collection chamber, which baffle plate is inclined upwardly along it length towards the collection chamber.

8. An electrolytic cell for the production of a metal by electrolysis of a molten electrolyte which is more dense than the metal, comprising an electrolysis chamber, a metal collection chamber, means for conducting product metal and electrolyte from an upper region of the electrolysis chamber to the metal collection chamber, means for conducting electrolyte from the metal collection chamber to a lower region of the electrolysis chamber, at least one electrode assembly including a cathode assembly defining within it a vertical cavity, an anode disposed within said cavity, at least one intermediate bipolar electrode assembly disposed between the anode and the cathode assembly, means for preventing or impeding flow of the electrolyte between the cathode assembly and a wall of the electrolysis chamber and/or between the cathode assembly and an adjacent cathode assembly, said cathode assembly having an end remote from the collection chamber disposed in close substantially sealing proximity to said wall of the electrolysis chamber, said flow-preventing or flow-impeding means comprising at least one horizontal layer in the surface of said wall facing the cathode assembly which layers are of a material more highly resistant than other parts of said surface to erosion by the passage of electrolyte thereover.

9. An electrolytic cell for the production of a metal by electrolysis of a molten electrolyte which is more dense than the metal, comprising an electrolysis chamber, a metal collection chamber, means for conducting product metal and electrolyte from an upper region of the electrolysis chamber to the metal collection chamber, means for conducting electrolyte from the metal collection chamber to a lower region of the electrolysis chamber, at least one electrode assembly including a cathode assembly defining within it a vertical cavity, an anode disposed within said cavity, at least one intermediate bipolar electrode assembly disposed between the anode and the cathode assembly, means for preventing or impeding flow of the electrolyte between the cathode assembly and a wall of the electrolysis chamber and/or between the cathode assembly and an adjacent cathode assembly, each intermediate bipolar electrode assembly comprising two side plates, two end plates connected to and extending between the side plates to form an open-topped enclosure, the side plates having lower end portions which are mutually convergent but terminate short of each other to leave a gap therebetween.

10. An electrolytic cell as claimed in claim 9, wherein the anode has its external surface shaped to be parallel to and adjacent the side and end plates of the bipolar electrode assembly next adjacent to the anode.

* * * * *